United States Patent [19]

Chu et al.

[11] Patent Number: 5,070,339

[45] Date of Patent: Dec. 3, 1991

[54] TAPERED-ELEMENT ARRAY ANTENNA WITH PLURAL OCTAVE BANDWIDTH

[75] Inventors: Ruey S. Chu, Cerritos; Nam S. Wong, Fullerton; Ernie T. Ozaki, San Diego, all of Calif.

[73] Assignee: Hughes Aircraft Company, Los Angeles, Calif.

[21] Appl. No.: 456,018

[22] Filed: Dec. 21, 1989

[51] Int. Cl.[5] ..... H01Q 1/38

[52] U.S. Cl. ..... 343/700 MS; 343/846; 343/829

[58] Field of Search ..... 343/700 MS, 846, 829

[56] References Cited

U.S. PATENT DOCUMENTS

| | | | |
|---|---|---|---|
| 2,822,541 | 2/1958 | Sichak et al. | 343/700 MS |
| 4,051,476 | 9/1977 | Archer et al. | 343/700 MS |
| 4,500,887 | 2/1985 | Nester | 343/700 MS |
| 4,605,012 | 8/1986 | Ringeisen et al. | 343/700 MS |
| 4,843,403 | 6/1989 | Lalezari et al. | 343/700 MS |

FOREIGN PATENT DOCUMENTS

| | | | |
|---|---|---|---|
| 0131605 | 6/1987 | Japan | 343/700 MS |

*Primary Examiner*—Michael C. Wimer
*Assistant Examiner*—Hoanganh Le
*Attorney, Agent, or Firm*—Wanda K. Denson-Low

[57] ABSTRACT

An antenna for radiating electromagnetic power with plural octave bandwith is formed of an array of microstrip radiating elements each of which includes a microstrip conductor element spaced apart from a ground-plane element. A common ground-plane element is employed by all of the radiators in a row of the antenna, there being a plurality of the rows disposed parallel to each other. In each radiator, the microstrip conductor element is formed of an input section which is coupled to a feed, and an output section extending to an output end of the radiator for forming a radiating aperture of the radiator. In each output section, there is a two-dimensional enlargement of a cross-section of the radiator, one dimension of enlargement being parallel to the ground-plane element, and the other direction of enlargement being perpendicular to the ground-plane element. Enlargement in the direction parallel to the ground-plane element is accomplished by increasing the width of the conductor element. Enlargement in the direction perpendicular to the ground-plane element is accomplished by bending a portion of the conductor element away from the ground-plane element to provide for an inclination of the conductor element relative to the ground-plane element. Enlargement of the width may occur prior to or concurrently with enlargement of the dimension perpendicular to the ground-plane element.

21 Claims, 5 Drawing Sheets

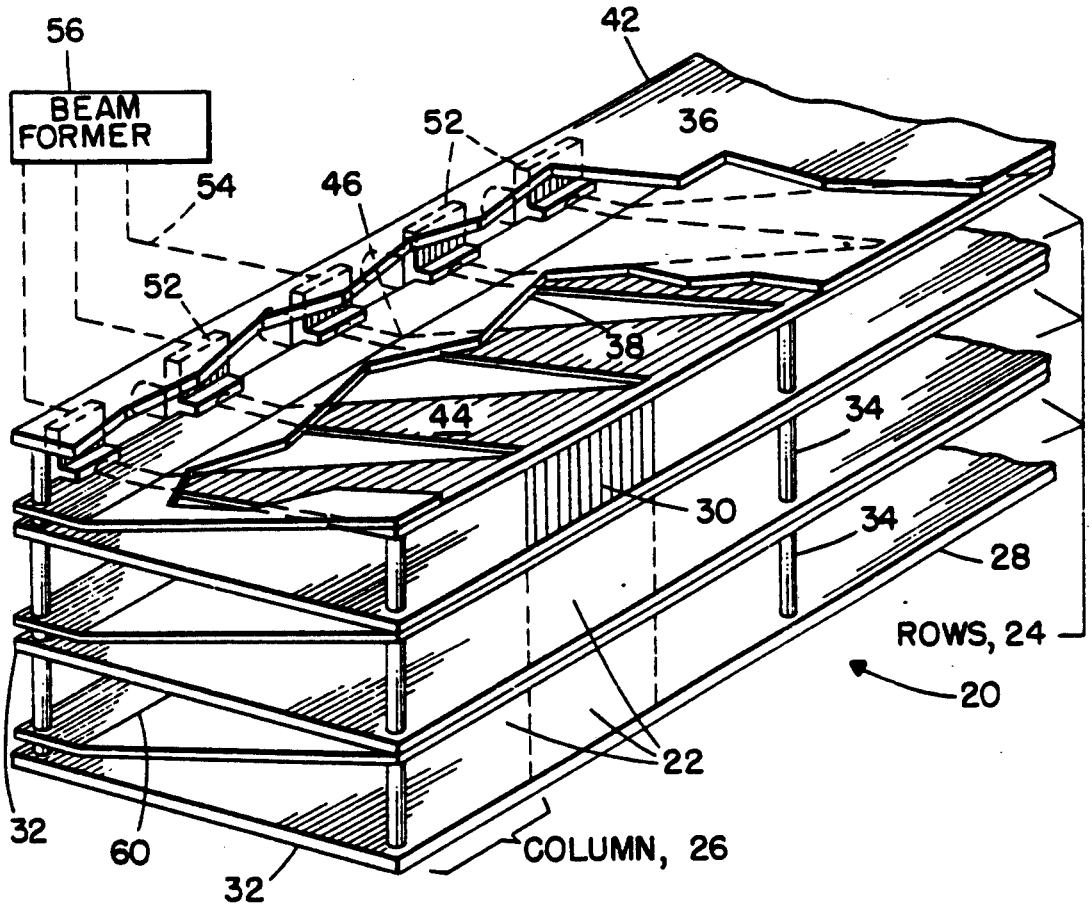
FIG. 3.
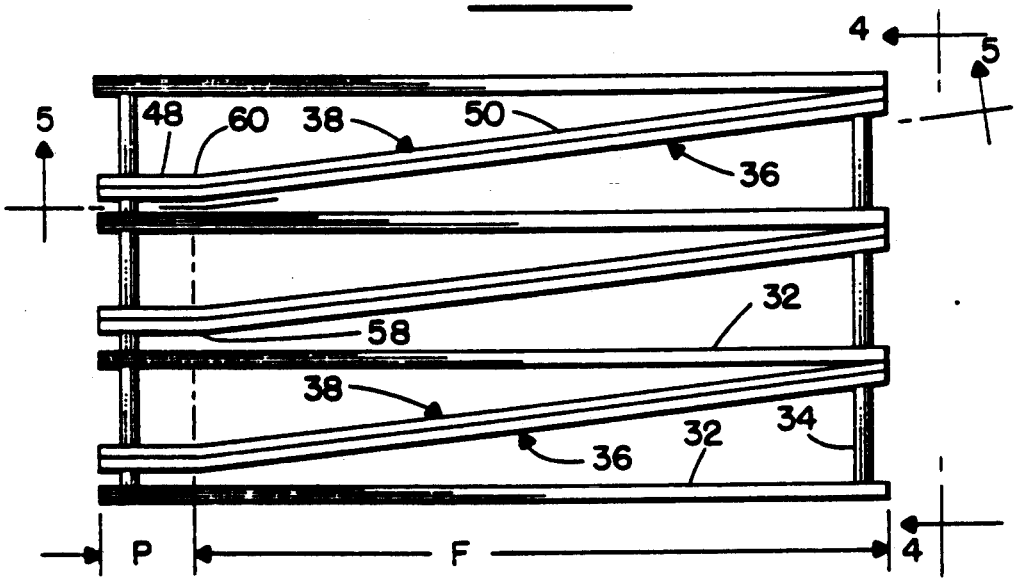

TAPERED-ELEMENT ARRAY ANTENNA WITH PLURAL OCTAVE BANDWIDTH

BACKGROUND OF THE INVENTION

This invention was made with government support. The government has certain rights in this invention.

This invention relates to microstrip antennas and, more particularly, to an array of microstrip antenna elements wherein each element is formed of a flared enlargement of an end portion of a microstrip conductor element, the end portion being at least partially developed with diverging orientation relative to a ground plane of the antenna element strip.

Microstrip antenna elements are employed in a variety of applications, including radar, communications, and electronic warfare systems The microstrip antenna elements are advantageous because they are readily constructed in a small physical size, have relatively light weight as compared to other forms of construction, facilitate the manufacturing process by virtue of the use of a dielectric substrate and photolithography of a microstrip conductor element upon the substrate, and because the microstrip antenna elements are readily connected to electrical circuitry formed on a circuit board sharing the ground plane of the microstrip antenna element.

A problem arises in that modern radar, communication, and electronic warfare systems would be operated advantageously at very wide bandwidths extending over a plurality of octaves. While numerous configurations of microstrip antenna elements have been developed, and while some of these microstrip antenna elements do have wide bandwidths, none of the presently available antenna elements, suitable for use on a phased array antenna, provide a sufficient bandwidth to optimize the capacity of the foregoing electronic systems. For example, present wide-band antenna-elements configurations are not suitable for multiple-octave bandwidth phased array applications due to poor impedance matching characteristics over the operating band. This deficiency applies not only to presently available microstrip antenna elements, but also to stripline antenna elements.

SUMMARY OF THE INVENTION

The aforementioned problem is overcome, and other advantages are provided by an array antenna employing radiating elements constructed in accordance with the invention. The radiating elements of the invention are formed as a modification of a microstrip radiating element wherein an outer end portion of a microstrip conductor of the radiating element is formed with a flared enlargement which enlarges the radiating aperture of the radiating element in a dimension parallel to a ground plane of the radiating element. Furthermore, in accordance with the invention, the radiating aperture of the radiating element is enlarged in a dimension perpendicular to the ground plane by bending at least a part of the outer end portion of the feed conductor away from the ground plane.

Thus, when viewed in a cross-sectional plane, transverse to a longitudinal axis of the microstrip feed conductor, the cross-sectional dimensions of the radiating element, both parallel to and perpendicular to the ground plane, increase with increasing distance from an input end of the radiating element. This geometry of the radiating element introduces a frequency insensitivity to the dominant mode of propagation of an electromagnetic wave propagating from an input end of the radiating element to an output end thereof to be radiated from the radiating element. The dominant mode is a transverse electromagnetic (TEM) wave. The radiating element operates in reciprocal fashion so as to perform equally well for both transmission and reception of electromagnetic power. The description herein, for convenience in explaining the invention, is presented in terms of a transmission mode of operation, the input and the output ends of the radiating element being described with reference to the transmission of an electromagnetic signal. It is understood that the explanation of the invention applies also to the reception of an electromagnetic signal.

Different embodiments of the invention are provided. In one embodiment of the radiating element, enlargement of the cross-sectional dimensions of the feed element occurs concurrently in both parallel and perpendicular directions relative to the ground plane. In a second embodiment of the invention, enlargement of the cross-sectional dimensions of the radiating element occurs initially in the direction parallel to the ground plane, this being followed by enlargement in the direction perpendicular to the ground plane. In yet a third embodiment of the invention, the enlargement of the cross-sectional dimension of the radiating element occurs concurrently in directions parallel to and perpendicular to the ground plane, this being followed with a subsequent enlargement solely in the direction perpendicular to the ground plane.

Dielectric material is located on a side of the microstrip feed conductor opposite the ground plane (so called inverted microstrip) to serve as a support for the conductor. In addition, a power absorber may be placed on the output end portion of the radiating element, on the side thereof opposite the ground plane, to minimize leakage of microwave power from one radiating element to an adjacent radiating element and, also, to attenuate other possible propagating modes of electromagnetic power, such as a surface wave propagating transversely along radiating apertures of successive ones of the radiating elements of the array. An embodiment of the invention is operative over two octaves, from 2 Ghz (gigahertz) to 8 GHz of the microwave spectrum.

BRIEF DESCRIPTION OF THE DRAWING

The aforementioned aspects and other features of the invention are explained in the following description, taken in connection with the accompanying drawing wherein:

FIG. 1 is a stylized perspective view of an array antenna constructed in accordance with the invention with a plurality of radiating elements arranged in rows and columns, a radiating aperture of a single radiating element being indicated diagrammatically, this embodiment of the invention being characterized by a simultaneous flaring of microstrip feed structures simultaneously and linearly in planes of the electric and the magnetic fields of electromagnetic waves supported by microstrip feed structures in the elements of the antenna;

FIG. 3 is a side elevation view of the antenna of FIG. 1, taken along the line 3—3 in FIG. 2;

DETAILED DESCRIPTION

Figure 2:
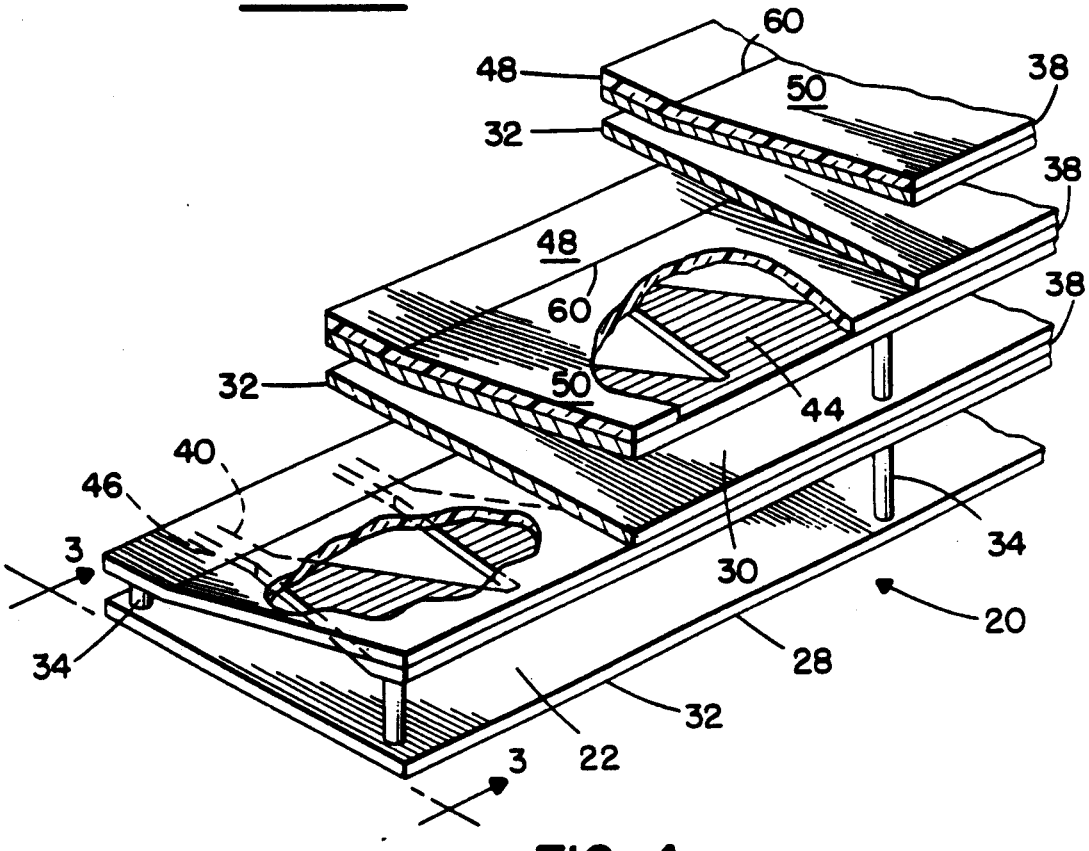
FIG. 2 is an enlarged fragmentary view of the antenna of FIG. 1, portions of the view of FIG. 2 being sectioned and cutaway to show components of the antenna.

FIGS. 1-5 show a first embodiment of an antenna 20 constructed in accordance with the invention. The antenna 20 is formed of an array of flared microstrip radiating elements 22 arranged in rows 24 and columns 26 as viewed from a front face 28 of the antenna 20. Each of the radiating elements 22 has a rectangular shaped radiating aperture 30 located in a front face 28 of the antenna 20, one such aperture 30 being illustrated in FIG. 1. The antenna 20 may contain any desired number of the rows 24, three of the rows being shown in FIG. 1, by way of example. The antenna 20 comprises four planar ground members 32 supported in spaced apart relation to each other by a set of posts 34.

The radiating elements 22 are arranged in the rows 24 between successive ones of the ground members 32. The radiating aperture 30 of an element 22 extends between successive ones of the ground members 32. Each of the radiating elements 22 comprises a microstrip conductor 36 bonded to a dielectric board 38 which supports the microstrip conductor 36 in spaced-apart relation to a ground member 32. The microstrip conductor 36 is formed of electrically conductive material, preferably a metal such as copper or aluminum.

In accordance with a feature of the invention, each microstrip conductor 36 comprises a feed section 40 located towards a backside 42 of the antenna 20, and a flared section 44 extending from the feed section 40 towards the front face 28 of the antenna 20. The feed section 40 of each microstrip conductor 36 is formed with parallel sides and is disposed in parallel relationship to a ground member 32 with which it cooperates to form a feed 46 of a radiating element 22. The feed section 40 of the microstrip conductor 36 is identified by the legend P in FIG. 3 while the flared section 44 of the microstrip conductor 36 is identified by the legend F in FIG. 3.

It is noted that the construction of the feed 46 in each of the radiating elements 22 differs from the usual form of microstrip circuitry wherein a dielectric layer is positioned between a strip conductor and a ground plane. Herein, in the construction of the invention, there is employed a form of microstrip, sometimes referred to as inverted microstrip, wherein the dielectric board 38 is located on a side of the microstrip conductor 36 away from the ground member 32. This form of construction provides for an air dielectric disposed between the microstrip conductor 36 and the ground member 32. The use of the air dielectric in the feed 46, as well as in the construction of the flared region F of the radiating element 22 minimizes any dielectric mismatch between the feed 46 and the radiating aperture 30 of the radiating element 22.

Flared section 44 of a microstrip conductor 36 provides for a gradual increase in the width of the conductor 36 with increasing distance from the feed section 40. The increase of width, or flaring of the conductor 36, occurs in a direction transverse to a longitudinal axis of the conductor 36 and parallel to an intersection of a ground member 32 with the front face 28 of the antenna 20.

In accordance with a further feature of the invention, the flared section 44 of each microstrip conductor 36 is bent at the junction between the flared section 44 and the feed section 40 so as to provide for an inclination of the flared section 44 relative to the ground member 32, This is accomplished by constructing the dielectric board 38 of two planar sections, namely, a back section 48 and a front section 50. The back section 48 is parallel to the ground member 32. The front section 50 with the flared section 44 of the microstrip conductor 36 mounted thereto are inclined relative to the ground member 32. Upon viewing a radiating element 22 from its side, it is apparent that the inclination of the front section 50 of the dielectric board 38 provides for a flaring of the radiating element 22 in a direction perpendicular to the ground member 32. The extent of the flaring of the radiating element 22 parallel and perpendicular to the ground member 32 establishes the dimensions of the radiating aperture 30.

As is well known, a microstrip conductor supports a traveling transverse electromagnetic wave. Accordingly, the feed 46 of each of the radiating elements 22 supports a TEM wave with electric field extending between the feed section 40 of the microstrip conductor 36 and the ground member 32. The magnetic field of the TEM wave encircles the feed section 40 in a plane normal to a longitudinal axis of the feed section 40. In the region between the feed section 40 and the ground member 32, the magnetic field extends in a direction parallel to the intersection of the ground member 32 with the front face 28 of the antenna 20. With respect to the foregoing directions of the electric and the magnetic fields, enlargement of the width of the flared section 44 provides for a flaring of the radiating element 22 in the H-plane direction, while inclination between the flared section 44 and the ground member 32 provides for a flaring in the E-plane direction.

The flaring of the radiating element 22 is done gradually so that the electromagnetic wave can travel the full extent of a microstrip conductor 36. The flaring provides that the conductor 36, in cooperation with the ground member 32 serves as a tapered transmission line for propagation of electromagnetic power. The characteristic impedance of the transmission line varies in accordance with the cross-sectional dimensions of the line. It is convenient to form the feed 46 to have an impedance of 50 ohms.

The antenna 20 includes also a set of wave launchers 52, of conventional construction, shown in phantom in FIG. 1 and located along the back side 42 of the antenna 20. Each of the launchers 52 provides for the coupling of electromagnetic power between a coaxial transmission line 54 and the feed 46 in each of the respective ones of the radiating elements 22. Both the launcher 52 and the radiating element 22 coupled to the launcher 52 operate in reciprocal fashion to accommodate both the transmission and reception of electromagnetic signals via the radiating element 22. By way of example in the use of the antenna 20, the wave launchers 52 may be coupled via their respective coaxial transmission lines 54 to a beam former 56 which imparts suitable phase shifts, in a well-known manner, to electromagnetic signals applied to the respective radiating elements 22 for the forming and the steering of a beam of electromagnetic radiation by the antenna 20.

Figure 4:
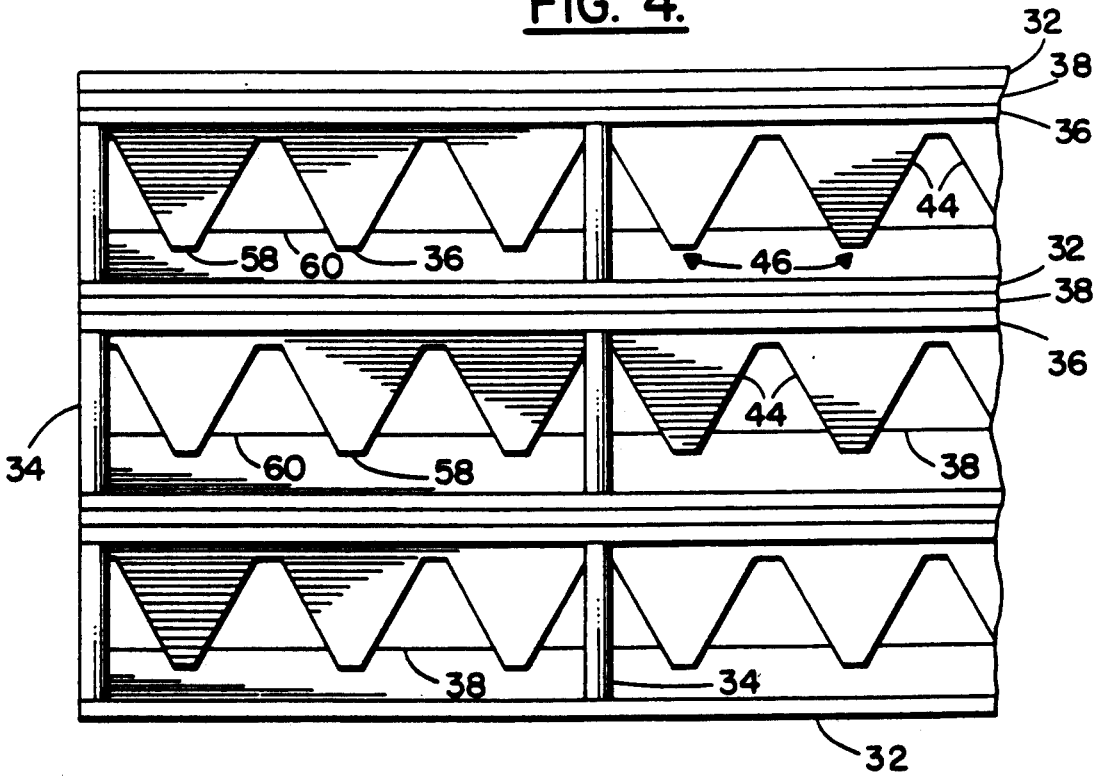
FIG. 4 is a front elevation view, taken along the line 4—4 in FIG. 3, looking into the radiating apertures of the elements of the antenna of FIG. 1.
Figure 5:
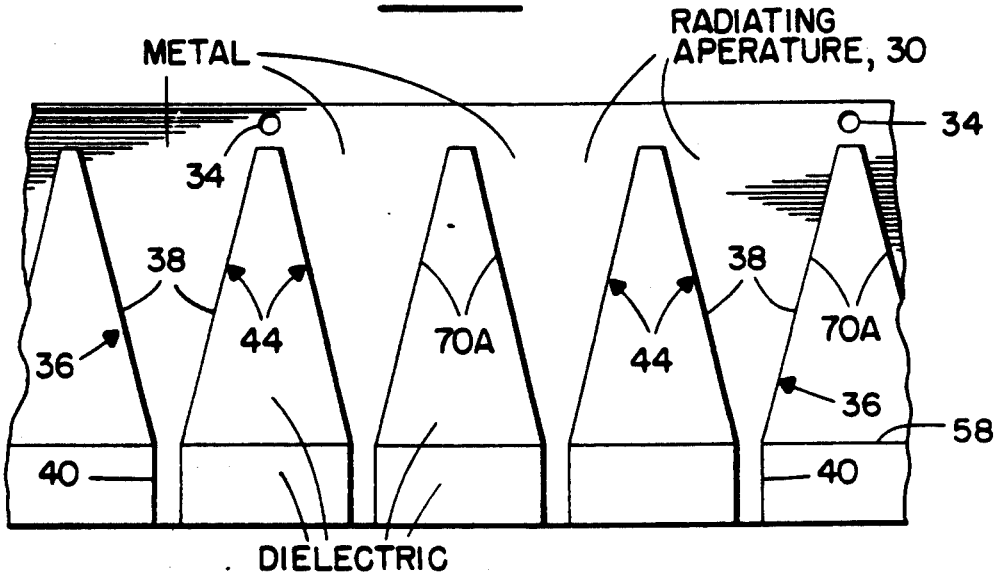
FIG. 5 is a plan view of an array of microstrip metallic feed elements with flared end portions supported upon a dielectric board, taken along the line 5—5 in FIG. 3.

As shown in FIGS. 2, 4, and 5, the front ends of the flared sections 44 of the respective radiating element 22 contacts each other immediately behind the front face 28 of the antenna 20. This provides for substantially uniform illumination of the entire radiating aperture of the antenna 20, the radiating aperture of the antenna 20 comprising the set of individual radiating apertures 30 of the individual elements 22. In each of the radiating elements 22, bending of the microstrip conductor 36 is accomplished at a bend line 58 shown in FIGS. 4 and 5. A corresponding bend line 60, immediately above the bend line 58, separates the front section 50 of the dielectric board 38 from the back section 48 of the board 38 as shown in FIGS. 1 and 2. In this embodiment of the invention, flaring in both the E-plane and H-plane occur concurrently, beginning at the bend line 58. In contrast, as will be described hereinafter with respect to other embodiments of the invention, the flaring in the two perpendicular planes may occur sequentially or as a composite of both concurrent and sequential flaring.

As a further feature in the construction of each radiating element 22 the rate of tapering in the H-plane is the same as the rate of tapering in the E-plane in order to retain the same ratio, in each cross-sectional plane of the radiating element 22, of the line width of the conductor 36 to the ground plane spacing between the conductor 36 and the ground member 32. By retaining the same ratio of line width to ground plane spacing, the characteristic impedance of the microstrip transmission line of the radiating element 22 is maintained constant throughout the flared transition between the feed 46 to the radiating aperture 30. The constant impedance virtually eliminates transmission line mismatches. Thus, the construction of each radiating element 22 employs two mechanisms for minimizing impedance mismatches between the feed 46 and the radiating aperture 30, namely, the constant line impedance in the flared region, and the use of the air dielectric provided by the inverted microstrip construction. An additional feature of the embodiment of the invention disclosed in FIGS. 1-5 is the minimization of the length of the flared region of the radiating element 22 by providing for a flaring in the H-plane concurrently with a flaring in the E-plane.

Figure 6:
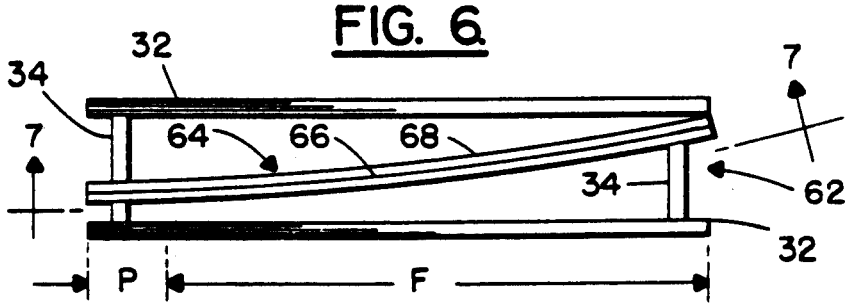
FIG. 6 is an elevation view of a single row of radiating elements in an alternative embodiment of the antenna of FIG. 3 wherein the metallic microstrip feeds and the supporting dielectric board, are curved to provide a curvature of flare in the plane of an electric field of an electromagnetic wave supported by the radiating elements.
Figure 7:
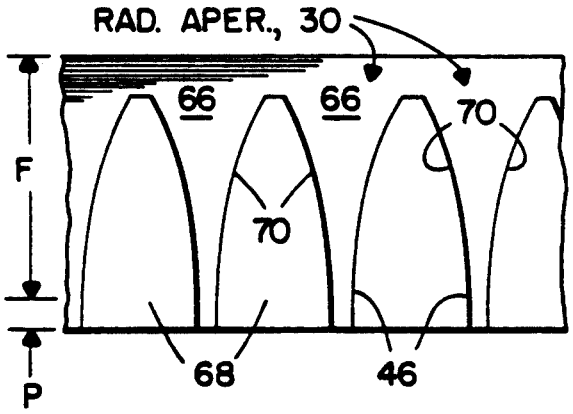
FIG. 7 is a plan view taken along the line 7—7 in FIG. 6, showing metallic microstrip feed elements supported by the dielectric board in the embodiment of FIG. 6, the feed elements in FIG. 7 having a flare with curvature in a plane of the magnetic field of the electromagnetic wave supported by the radiating elements.

FIGS. 6 and 7 are similar to FIGS. 3 and 5, and show an alternative construction of the embodiment of FIGS. 1-5 wherein the flaring in the E-plane (FIG. 6) is curved while the corresponding flaring in FIG. 3 is linear, and wherein the flaring in the H-plane (FIG. 7) is curved while the corresponding flaring of FIG. 5 is linear. The view of the antenna in FIG. 6 has been simplified by showing a side elevation of only a single row of radiating elements 62. In FIG. 6, the radiating element 62 is formed between two ground members 32 spaced apart by posts 34. The radiating element 62 is formed of a microstrip transmission line 64 comprising a microstrip conductor 66 disposed on a cylindrical surface of a supporting dielectric board 68 facing the bottom one of the ground members 32. Thus, the conductor 66 has a curved surface in comparison to the planar surface of the conductor 36 of FIG. 3. The side edges 70 of the microstrip conductor (FIG. 7) are curved in comparison to the straight edges 70A of the microstrip conductor 36 of FIG. 5. While the curved construction of the radiating element 62 of FIGS. 6 and 7 may entail greater complexity in manufacture than the linear embodiment of FIGS. 3 and 5, the curved embodiment of FIGS. 6 and 7 provides further control of reflection coefficient to transverse electromagnetic waves to minimize a standing wave ratio associated with the transmission of the electromagnetic wave along the transmission line 64 of the radiating element 62 Included within the microstrip transmission lines 64 is a feed section 40 wherein the microstrip conductor 66 is parallel to the ground member 32, and has parallel sides (indicated by the legend P) in the same fashion as was disclosed by the microstrip conductor 36 of FIGS. 1-5.

Figure 8:
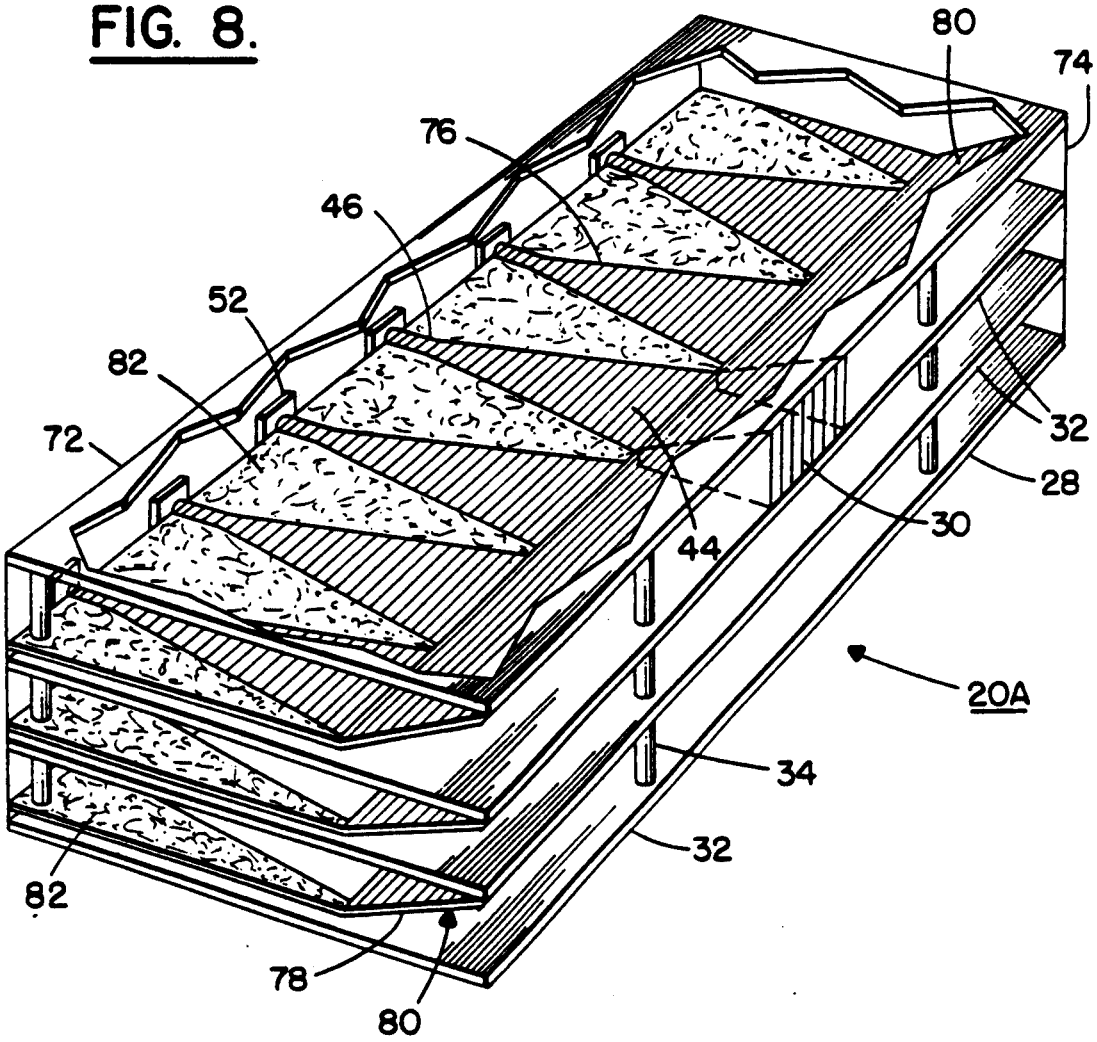
FIG. 8 is a stylized perspective view of an alternative embodiment of the antenna of the invention wherein flaring of the respective microstrip feed elements is accomplished first in the plane of the magnetic field followed by flaring in the direction of the electric field.
Figure 9:
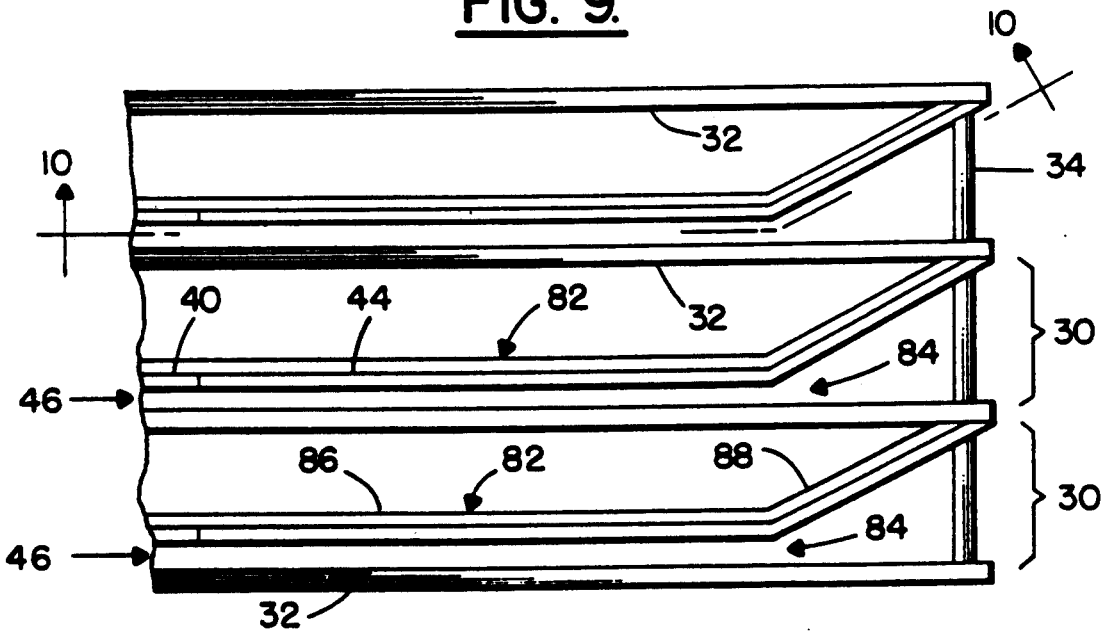
FIG. 9 is a side elevation view of the antenna of FIG. 8.
Figure 10:
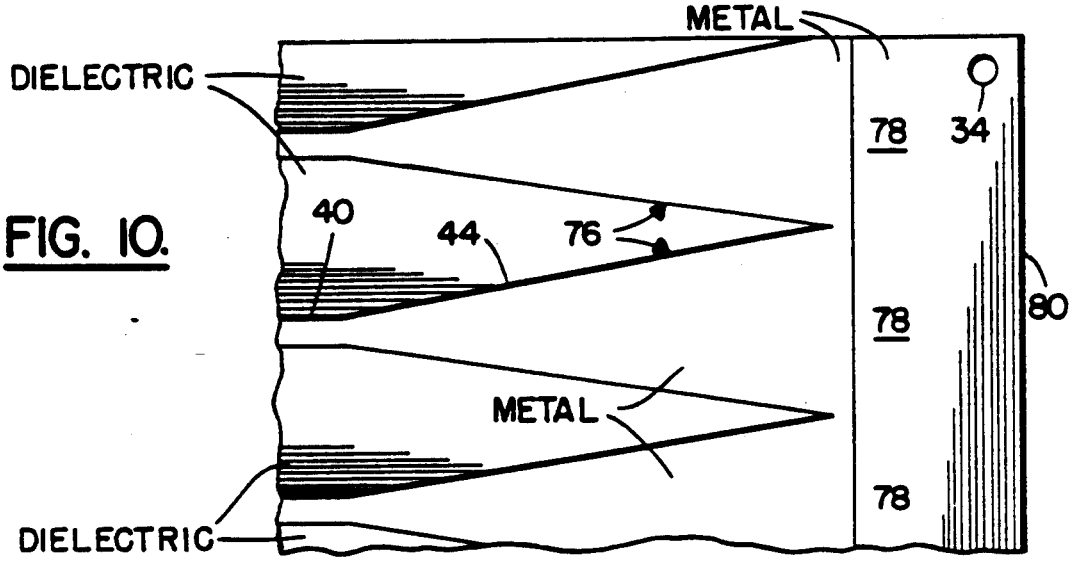
FIG. 10 is a plan view, taken along the line 10—10 in FIG. 9, of metallic microstrip feed elements supported upon a dielectric board in the antenna embodiment of FIG. 8.

FIGS. 8-10 show an antenna 20A which is an alternative embodiment to the antenna 20 of FIGS. 1-5. The antenna 20A differs from the antenna 20 in that, in the construction of the antenna 20A, flaring of a radiating element 22A is attained sequentially, the flaring occurring first in the H-plane followed by flaring in the E-plane. Otherwise, the construction shown in FIG. 8 is essentially that shown in FIG. 1 as may be seen by inspection of the two figures. The antenna 20A comprises four ground members 32 which are spaced apart relative to each other and are supported by posts 34. Also shown in FIG. 8 is an optional back wall 72 and an optional sidewall 74 of the antenna 20A. The back wall 72 and the sidewall 74 may be formed of radiation absorptive material to prevent reflections of radiation from these walls. In addition, these walls are useful in preventing escape of radiation to any neighboring electromagnetic equipment which may be present. The antenna 20A comprises a set of radiating elements 22A arranged in rows and columns in the same fashion as was disclosed in the construction of the antenna 20 of FIGS. 1-5.

Each of the radiating elements 22A comprises a microstrip conductor 76 having the feed section 40 and the flared section 44 as has been disclosed with reference to FIG. 5. The microstrip conductor 76 further comprises a rectangular front portion which abuts the sides of the front portions 78 of adjacent radiating elements 22A to form a continuous metallic strip 80 along the front face 88 of the antenna 20A. The microstrip conductor 76 is supported by a dielectric board 82 located on a side of the conductor 76 opposite the ground member 32. The microstrip conductor 76 in each radiating element 22A is spaced apart from the ground member 32 by the dielectric board 82 to form a microstrip transmission line 84 which can support a transverse electromagnetic wave. The dielectric board 82 is formed of a planar back section 86 which is parallel to the ground member 32 and a planar front section 88 which is inclined relative to the ground member 32. The back section 82 supports the feed section 40 and the flared section 44 of the microstrip conductor 76 in parallel relation to the ground member 32, while the front section 88 of the dielectric board 82 supports the front portion 78 of the microstrip conductor 76 in inclined relation to the ground member 32.

The parallel disposition of the flared section 44 of the microstrip conductor 76 relative to the ground member 32 provides for a flaring of the microstrip transmission line 84 only in the H-plane. The subsequent inclination of the front portion 78 of the microstrip conductor 76 relative to the ground member 32 provides for a flaring of the microstrip transmission line 84 only in the E-plane, by flaring the two metal plates of the front portion 78. Thus, the configuration of the microstrip transmission line 84, and front E-flare portion 44 of the radiating element 22A at the feed 46 and at the radiating aperture 30 is the same as that disclosed for the radiating element 22 of FIGS. 1-5. The impedance of the transmission lines of the two radiating elements are the same at the feeds, and are the same at the radiating apertures. However, the impedance at the flared section 44 of the transmission line of the radiating element 22A differs from the impedance of the flared section 44 of the transmission line of the radiating element 22 because of the different cross-sectional dimensions of the two transmission lines.

As noted hereinabove, the construction of the radiating element 22 of FIGS. 1-5 is useful in preserving a constant characteristic impedance along the transmission line for minimization of any mismatch. However, the inclined attitude of the flared section 44 in FIGS. 1-5 facilitates a coupling of electromagnetic power between adjacent ones of the radiating elements 22. This is disadvantageous in situations wherein it is desired to retain precise control of phase shift, or other signal parameter, individually among the various radiating elements. In contrast, the parallel relationship between the flared section 44 and the ground member 32 in FIGS. 8-10 inhibits leakage of electromagnetic power between adjacent ones of the radiating elements. However, the radiating elements of FIGS. 8-10 have a greater length than the radiating elements of FIGS. 1-5, the greater length being possibly disadvantageous in situations requiring a compact configuration of the antenna.

Figure 13:
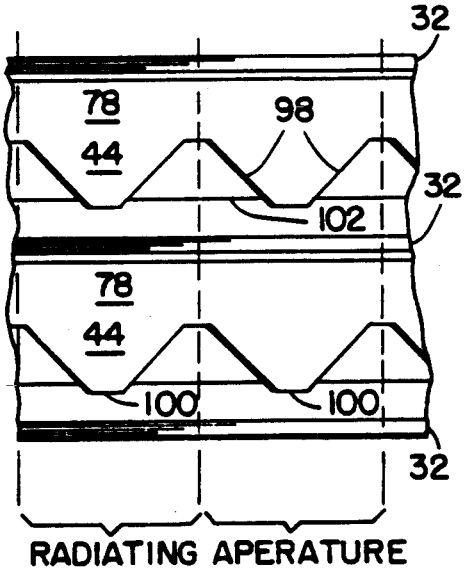
FIG. 13 is a front elevation view of the antenna of FIG. 11, taken along the line 13—13 in FIG. 11, and showing radiating apertures of respective radiating elements of the antenna.
Figure 11:
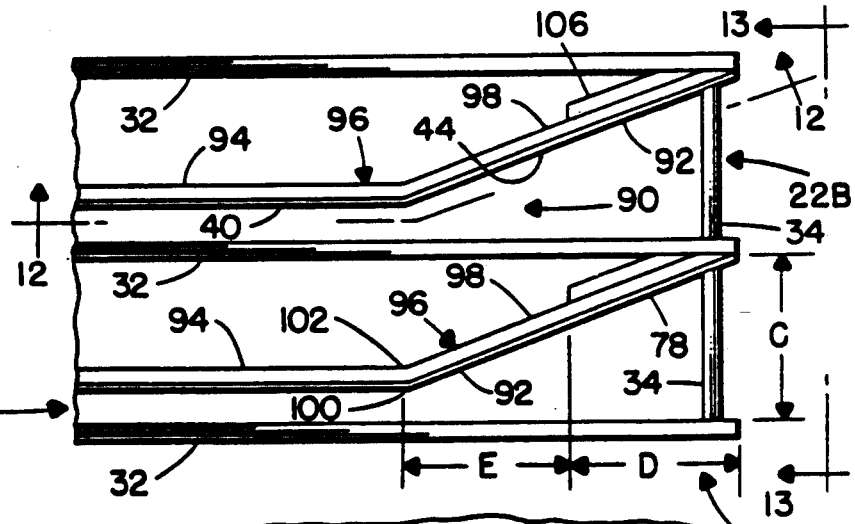
FIG. 11 is a side elevation view of a further embodiment of the antenna of FIG. 1, the embodiment of FIG. 11 being a hybrid employing simultaneous flaring in both planes of the magnetic and the electric fields of the electromagnetic wave followed by further flaring solely in the direction of the electric field.
Figure 12:
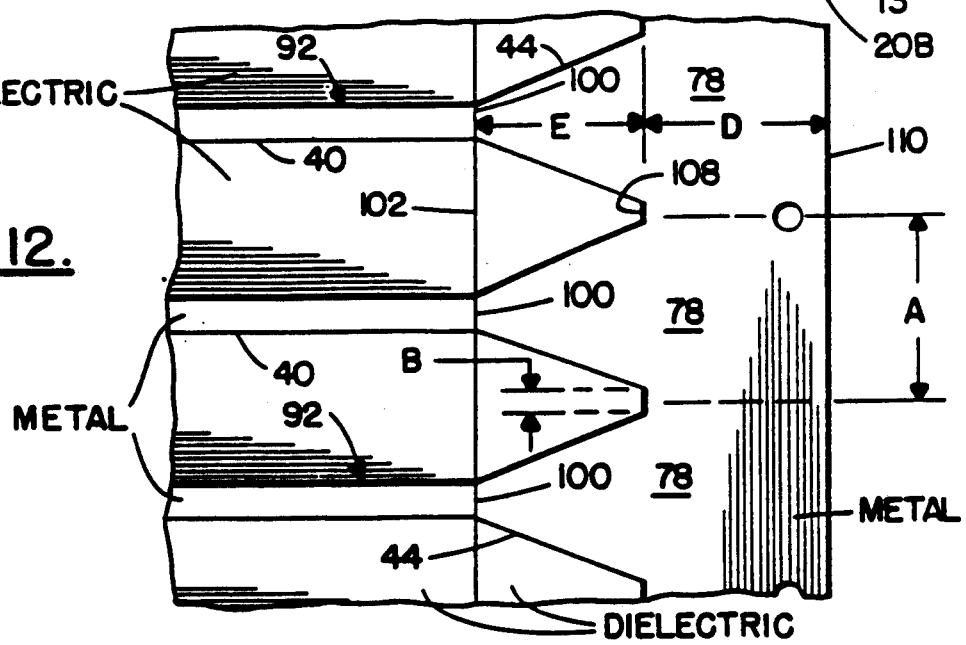
FIG. 12 is a plan view, taken along the line 12—12 in FIG. 11, showing metallic microstrip feed elements with flaring supported by a dielectric board of FIG. 11.

FIGS. 11-13 show construction of an antenna 20B which is an alternative embodiment to the embodiments disclosed in FIGS, 1 and 8. In FIGS. 11-13, the antenna 20B is constructed in the same general fashion as the antennas of FIGS. 1 and 8, and includes ground members 32 which are spaced apart from each other and supported by posts 34. The antenna 20B includes an array of radiating elements 22B of which two elements 22B are shown in side elevational view in FIG. 11. Each radiating element 22B includes a microstrip transmission line 90 comprising a microstrip conductor 92 disposed in spaced-apart relation to the ground member 32. The microstrip conductor 92 includes the feed section 40, described in previous embodiments of the invention, which is held in a plane parallel to the ground member 32 by a back section 94 of a dielectric supporting board 96.

The board 96 is positioned on a side of the microstrip conductor 92 opposite the ground member 32 to provide for an air dielectric between the conductor 92 and the ground member 32. The dielectric board 96 includes a front section 98 which is inclined relative to the ground member 32, and supports a flared section 44 of the microstrip conductor 92 in a planar configuration inclined with respect to the ground member 32. Also included in the microstrip conductor 92 is a rectangular front portion 78 which abuts the sides of the front portions 78 of adjacent ones of the radiating elements 22B in the same manner as was described previously with reference to the microstrip conductor 76 of FIGS. 8-10. The front portions 78 are supported in a planar form angled with respect to the ground member 32 by the front section 98 of the dielectric board 96.

The embodiment of FIGS. 11-13 may be regarded as a hybrid combination of the structures of the embodiment of FIGS. 1-5 and 8-10. It is recalled that, in the embodiment of FIGS. 1-5, flaring in the H-plane and the E-plane occurs concurrently. In the embodiment of FIGS. 8-10, flaring occurs first in the H-plane followed by flaring subsequently in the E-plane. In the embodiment of FIGS. 11-13, flaring of the microstrip conductor 92 begins at a bend line 100 in the microstrip conductor, this bend line corresponding to a bend line 102 in the dielectric board 96. The flaring of the microstrip conductor 92 proceeds forward along outwardly extending side edges 104 towards the maximum width of the microstrip conductor 92.

The flared section 44 of the microstrip conductor 92 is disposed totally upon the inclined planar front section 98 of the dielectric board 96 with the result that flaring of the radiating elements 22B occurs concurrently in both the H-plane and the E-plane. The extent of this flaring along the longitudinal dimensions of the conductor 92 is indicated in FIGS. 11 and 12 by the letter E. Thereafter, flaring continues but only in the E-plane. This additional region of flaring is indicated in FIGS. 11 and 12 by the letter D. Because of the inclination of the flared section 44 in each of the radiating elements 22B, there may be some leakage of electromagnetic radiation extending in the region above the dielectric board 96. It is advantageous to absorb such radiation by placing an absorber 106 of radiation above the front section 98 of the board 96 in the region designated D as shown in FIG. 11. The angle of flare of the flared section 44, the angle formed between the side edges 70A (FIG. 5) or 104 (FIG. 12), is minimized for reduced reflection coefficient and maximized to reduce overall length of a radiating element, a typical range of angle being 10-60 degrees.

In comparing the operation of the embodiments of FIGS. 11-13 and FIGS. 8-10, it is noted that the radiating apertures 30 have the same dimensions in all of the embodiments. In FIG. 11, the inclination of the front section 98 of the board 96 is less than the corresponding inclination of the front section 50 of the board 38 in FIG. 3. Therefore, there tends to be less leakage of microwave radiation between adjacent radiating elements in the embodiment of FIG. 11 than in the embodiment of FIG. 3. It is also noted that, in the construction of the embodiments of FIGS. 8-10 and FIGS. 11-13, that the flaring can be linear, as has been disclosed in these figures, or may be curved as disclosed in FIGS. 6 and 7. Also, if desired, curvature for E-plane flaring (FIG. 6) can be applied to any one of the disclosed embodiments while retaining the linear flaring in the H-plane. Or, alternatively, flaring in the H-plane may be curved (as shown in FIG. 7) while flaring in the E-plane is linear.

The following dimensions are employed in constructing the antenna of the invention to operate over a frequency band of 2 GHz to 8 GHz. in FIG. 12, the width of a radiating element, dimension A, as measured in the H-plane is 1.6 inches A flattened vertex 108 formed by the sides 104, dimension B, has a width of 0.1 inches. The length of the flared section 44 of the microstrip conductor 92, dimension E as measured along an axis of the radiating element is 4.0 inches. The distance between the vertices 108 and the front edge 110 of the microstrip conductor 92, dimension D, is 1.8 inches. In FIG. 11, the height of the radiating aperture, dimension C, is 0.75 inches. Tests performed with an embodiment of the invention constructed in accordance with the invention provides for a radiation bandwidth extending from 2 GHz to 8 GHz with a voltage standing wave ratio (VSWR) in a range of 1.1-1.2 over a major portion of the band with two excursions to approximately 1.2 and two other excursions to approximately 1.4. Thus, the invention is able to provide plural octave bandwidth to an antenna constructed of an array of microstrip radiating elements.

It is to be understood that the above described embodiments of the invention are illustrative only and that modifications thereof may occur to those skilled in the art. Accordingly, this invention is not to be regarded as limited to the embodiments disclosed herein, but is to be limited only as defined by the appended claims.

What is claimed is:

1. A microstrip radiator comprising:

an input end and an output end, and a ground-plane element extending from said input end to said output end;

a microstrip conductor element extending lengthwise across said radiator from said input end to said output end and having an input section at said input end of said radiator and an output section at said output end of said radiator;

a dielectric layer disposed contiguous said microstrip conductor element on a side of said microstrip conductor element opposite said ground-plane element to form an inverted microstrip with an air dielectric between said microstrip conductor element and said ground-plane element; and wherein said conductor element is spaced apart from said ground plane element;

said input section of said conductor element is of uniform width and is disposed at a predetermined spacing parallel to said ground-plane element;

said output section of said conductor element varies in width from a minimum width contiguous said input section to a larger width distant from said input section; and at least a part of said output section of said conductor element is oriented at a varying spacing relative to said ground-plane element to extend from said predetermined spacing to a larger spacing, said varying spacing increasing with increasing distance from said input end of said radiator.

2. A radiator according to claim 1 wherein said output section of said conductor element reaches a maximum width at a central portion of said output section of said conductor element distant from said output end of said radiator.

3. A radiator according to claim 2 wherein a further part of said output section of said conductor element is located adjacent said input section of said conductor element and is disposed at said predetermined spacing, and said output section of said conductor element reaches a maximum width in said further part of said output section.

4. A radiator according to claim 1 wherein said output section of said conductor element reaches a maximum width in said part of said output section oriented at the varying spacing.

5. A radiator according to claim 1 wherein all of said output section of said conductor element is oriented at said varying spacing.

6. A radiator according to claim 1 wherein a further part of said output section of said conductor element is located adjacent said input section of said conductor element and is disposed at said predetermined spacing, and said output section of said conductor element reaches a maximum width in said further part of said output section.

7. A radiator according to claim 1 wherein said output section of said conductor element reaches a maximum width in said part of said output section oriented at the varying spacing.

8. A radiator according to claim 7 further comprising an absorber of electromagnetic power disposed in said output section of said conductor element on a side of said conductor element opposite said ground plane element.

9. A radiator according to claim 1 wherein all of said output section of said conductor element is oriented at said varying spacing.

10. A radiator according to claim 9 further comprising an absorber of electromagnetic power disposed in said output section of said conductor element on a side of said conductor element opposite said ground plane.

11. An antenna comprising an array of radiators arranged in rows and in columns, there being a plurality of the radiators arranged side-by-side in each of said rows, there being a common ground-plane element in each of said rows, the radiators of each row sharing the common ground-plane element of the row;

each of said radiators further comprising:

an input end and an output end, and a ground-plane element extending from said input end to said output end;

a microstrip conductor element extending lengthwise across said radiator from said input end to said output end and having an input section at said input end of said radiator and an output section at said output end of said radiator;

a dielectric layer disposed contiguous said microstrip conductor element on a side of said microstrip conductor element opposite said ground-plane element to form an inverted microstrip with an air dielectric between said microstrip conductor element and said ground-plane element; and wherein said conductor element is spaced apart from said ground plane element;

said input section of said conductor element is of uniform width and is disposed at a predetermined spacing parallel to said ground-plane element;

said output section of said conductor element varies in width from a minimum width contiguous said input section to a larger width distant from said input section; and at least a part of said output section of said conductor element is oriented at a varying spacing relative to said ground-plane element to extend from said predetermined spacing to a larger spacing, said varying spacing increasing with increasing distance from said input end of said radiator.

12. An antenna according to claim 11 wherein the output section of one of said radiators is contiguous the output section of the next radiator in a row of said radiators.

13. A radiator according to claim 12 wherein said output section of said conductor element reaches a maximum width in said part of said output section oriented at the varying spacing.

14. A radiator according to claim 13 further comprising an absorber of electromagnetic power disposed in said output section of said conductor element on a side of said conductor element opposite said ground plane element.

15. A radiator according to claim 12 wherein all of said output section of said conductor element is oriented at said varying spacing.

16. A radiator according to claim 15 further comprising an absorber of electromagnetic power disposed in said output section of said conductor element on a side of said conductor element opposite said ground plane.

17. A radiator according to claim 11 wherein said output section of said conductor element reaches a maximum width at a central portion of said output section of said conductor element distant from said output end of said radiator.

18. A radiator according to claim 17 wherein a further part of said output section of said conductor element is located adjacent said input section of said conductor element and is disposed at said predetermined spacing, and said output section of said conductor element reaches a maximum width in said further part of said output section.

19. A radiator according to claim 11 wherein said output section of said conductor element reaches a maximum width in said part of said output section oriented at the varying spacing.

20. A radiator according to claim 11 wherein all of said output section of said conductor element is oriented at said varying spacing.

21. A radiator according to claim 11 wherein a further part of said output section of said conductor element is located adjacent said input section of said conductor element and is disposed at said predetermined spacing, and said output section of said conductor element reaches a maximum width in said further part of said output section.

* * * * *